US010242787B2

(12) United States Patent
Tanaka et al.

(10) Patent No.: US 10,242,787 B2
(45) Date of Patent: Mar. 26, 2019

(54) SOLENOID DEVICE AND SOLENOID SYSTEM

(71) Applicants: NIPPON SOKEN, INC., Nishio, Aichi-pref. (JP); DENSO CORPORATION, Kariya, Aichi-pref. (JP); ANDEN CO., LTD., Anjo, Aichi-pref. (JP)

(72) Inventors: Ken Tanaka, Nishio (JP); Shota Iguchi, Kariya (JP); Tomoaki Tanaka, Anjo (JP)

(73) Assignees: NIPPON SOKEN, INC., Nishio (JP); DENSO CORPORATION, Kariya (JP); ANDEN CO., LTD., Anjo (JP)

( * ) Notice: Subject to any disclaimer, the term of this patent is extended or adjusted under 35 U.S.C. 154(b) by 252 days.

(21) Appl. No.: 15/358,766

(22) Filed: Nov. 22, 2016

(65) Prior Publication Data

US 2017/0148557 A1 May 25, 2017

(30) Foreign Application Priority Data

Nov. 23, 2015 (JP) ..... 2015-228259

(51) Int. Cl.
*H01F 7/18* (2006.01)
*H01F 7/06* (2006.01)
(Continued)

(52) U.S. Cl.
CPC ..... *H01F 7/1805* (2013.01); *H01F 7/064* (2013.01); *H01F 7/081* (2013.01); *H01F 7/13* (2013.01); *H01F 7/16* (2013.01); *H01F 7/1638* (2013.01); *H01H 51/20* (2013.01); *H01F 2007/1692* (2013.01)

(58) Field of Classification Search
CPC ..... H01F 7/1805; H01F 7/064; H01F 7/13; H01F 7/16; H01F 2007/1692; H01H 51/20
See application file for complete search history.

(56) References Cited

U.S. PATENT DOCUMENTS

2002/0170986 A1* 11/2002 Rieger ..... F01L 9/04 239/585.1
2014/0225691 A1 8/2014 Tanaka et al.
2015/0070801 A1* 3/2015 Endozo ..... H01H 73/00 361/2

FOREIGN PATENT DOCUMENTS

JP 2014-103219 A 6/2014

* cited by examiner

*Primary Examiner* — Zeev V Kitov
(74) *Attorney, Agent, or Firm* — Oliff PLC

(57) ABSTRACT

A solenoid device includes two electromagnetic coils, two stationary cores, two plungers and a yoke that surrounds the two electromagnetic coils. When a first electromagnetic coil is energized, magnetic flux flows through a first magnetic circuit that includes the first stationary core. When the two electromagnetic coils are energized, magnetic flux of the first electromagnetic coil flows through the first magnetic circuit, and magnetic flux of the second electromagnetic coil flows through a second magnetic circuit that includes a second stationary core. When energization of the first electromagnetic coil is stopped while maintaining energization of the second electromagnetic coil, the magnetic flux of the second electromagnetic coil continues to flow through the second magnetic circuit and a third magnetic circuit that includes the two stationary cores. A magnetism limiting portion is disposed in a portion of the second magnetic circuit that does not overlap the third magnetic circuit.

6 Claims, 16 Drawing Sheets

(51) Int. Cl.

| | |
|---|---|
| ***H01F 7/13*** | (2006.01) |
| ***H01F 7/16*** | (2006.01) |
| ***H01H 51/20*** | (2006.01) |
| ***H01F 7/08*** | (2006.01) |

SOLENOID DEVICE AND SOLENOID SYSTEM

CROSS-REFERENCE TO RELATED APPLICATION

This application is based on and claims the benefit of priority from Japanese Patent Application No. 2015-228259, filed Nov. 23, 2015. The entire disclosure of the above application is incorporated herein by reference.

BACKGROUND

Technical Field

The present disclosure relates to a solenoid device that includes two electromagnetic coils and two plungers, and a solenoid system in which the solenoid device is used.

Related Art

As a component that is used in a relay and the like, a solenoid device is known that moves a plunger in a forward and backward direction, using an electromagnetic coil (refer to JP-A-2014-170738). The solenoid device includes two electromagnetic coils and two plungers. A stationary core composed of a soft magnetic material is disposed within each electromagnetic coil. Each plunger is disposed such as to oppose the stationary core with a predetermined distance therebetween. When the electromagnetic coil is energized, magnetic force is generated. The plunger is attracted to the stationary core. The solenoid device is configured to move the plungers in the forward and backward direction by energizing and deenergizing the electromagnetic coils.

As described hereafter, in the above-described solenoid device, there is a case in which both of the two plungers are attracted to the stationary cores, and a case in which only either of the plungers is attracted to the stationary core. The amount of time over which both of the two plungers are attracted to the stationary cores is long. In this case, there is a need for power consumption of the electromagnetic coils to be reduced. To address this need, the solenoid device is configured in the following manner.

That is, the electromagnetic coils are a first electromagnetic coil and a second electromagnetic coil. The plungers are a first plunger and a second plunger.

In the case in which only either (first plunger) of the plungers is attracted, both of the two electromagnetic coils are energized (see FIG. 15). Magnetic flux generated by energization of the first electromagnetic coil flows through a first magnetic circuit and a third magnetic circuit (shared magnetic circuit). The first magnetic circuit includes only the first plunger of the two plungers. The third magnetic circuit includes both of the two plungers. A magnetism limiting portion that limits magnetic flux is formed in the first magnetic circuit. As a result, the magnetism limiting portion limits the magnetic flux of the first magnetic circuit. Excess magnetic flux flows through the third magnetic circuit.

In addition, the magnetic flux generated by energization of the second electromagnetic coil flows through the third magnetic circuit in a direction opposite that of the magnetic flux flowing through the first electromagnetic coil. As a result, the magnetic flux of the first electromagnetic coil flowing through the third magnetic circuit is canceled by the magnetic flux of the second electromagnetic coil. Therefore, the magnetic flux apparently does not flow through the third magnetic coil, but flows through only the first magnetic coil. Only the first plunger is attracted.

In the case in which both of the two plungers are attracted, the two electromagnetic coils are energized. Then, energization of the second electromagnetic coil is stopped (see FIG. 16). As a result, the magnetic flux of the second electromagnetic coil dissipates, and the magnetic flux of the first electromagnetic coil continues to flow through the third magnetic circuit. Therefore, both of the two plungers can be attracted. At this time, because the second electromagnetic coil is not energized, the two plungers can be continuously attracted, while suppressing power consumption.

However, in the above-described solenoid device, a problem occurs in that it is difficult to stably attract only the first plunger. That is, in the solenoid device, in the case in which only the first plunger is attracted, the two electromagnetic coils are energized. The magnetic flux of the first electromagnetic coil flowing through the third magnetic circuit is cancelled by the magnetic flux of the second electromagnetic coil. Therefore, the amount of magnetic flux of the first electromagnetic coil and the amount of magnetic flux of the second electromagnetic coil flowing through the third magnetic coil are required to be substantially equal. The amount of magnetic flux generated by an electromagnetic coil may vary depending on temperature and the like. Therefore, the amount of generated magnetic flux is difficult to adjust.

In addition, a situation in which a malfunction occurs in either of the electromagnetic coils and sufficient magnetic flux is not generated is also possible. Consequently, a likelihood can be considered in that, in the above-described solenoid device, even should attraction of only the first plunger be attempted, the magnetic fluxes of the two electromagnetic coils are not completely canceled out in the third magnetic circuit. The remaining magnetic flux flows through the third magnetic circuit, and both of the two plungers are attracted

SUMMARY

It is thus desired to provide a solenoid device that is capable of stably attracting only either of two plungers, and reducing power consumption when attracting both of the two plungers, and a solenoid system in which the solenoid device is used.

An first exemplary embodiment provides a solenoid device that includes two electromagnetic coils that are configured by a first electromagnetic coil and a second electromagnetic coil, the first electromagnetic coil being energized to generate magnetic flux, the second electromagnetic coil being energized to generate magnetic flux; two stationary cores that are configured by a first stationary core and a second stationary core, the first stationary core being disposed within the first electromagnetic coil, the second stationary core being disposed within the second electromagnetic coil: two plungers that are configured by a first plunger and a second plunger, the first plunger being attracted to the first stationary core by energization of the first electromagnetic coil, the second plunger being attracted to the second stationary core by energization of the second electromagnetic coil; and a yoke that surrounds the two electromagnetic coils.

In a dual-deenergized state in which neither of the two electromagnetic coils is energized, the first plunger is separated from the first stationary core and the second plunger is separated from the second stationary core. When the dual-deenergized state is changed to a state in which only the first electromagnetic coil of the two electromagnetic coils is energized, magnetic flux of the first electromagnetic coil flows through a first magnetic circuit that includes only the first stationary core of the two stationary cores. The first plunger is thereby attracted to the first stationary core while maintaining a state in which the second plunger is separated from the second stationary core.

In a dual-energized state in which both of the two electromagnetic coils are energized, the magnetic flux of the first electromagnetic coil flows through the first magnetic circuit. The magnetic flux of the second electromagnetic coil flows through a second magnetic circuit that includes only the second stationary core of the two stationary cores. As a result of a magnetic force that is thereby generated, the first plunger is attracted to the first stationary core and the second plunger is attracted to the second stationary core. The magnetic fluxes, respectively generated from the first electromagnetic coil and the second electromagnetic coil, flow through a third magnetic circuit that includes the two stationary cores.

When, from the dual-energized state, energization of the first electromagnetic coil is stopped while maintaining energization of the second electromagnetic coil, the magnetic flux of the second electromagnetic coil continues to flow through the second magnetic circuit and the third magnetic circuit. As a result of a magnetic force that is thereby generated, a dual-attracting state in which the first plunger is attracted to the first stationary core and the second plunger is attracted to the second stationary core is maintained.

A magnetism limiting portion that limits magnetic flux is provided in only the second magnetic circuit, of the first magnetic circuit and the second magnetic circuit. The magnetism limiting portion is disposed in a portion of the second magnetic circuit that does not overlap the third magnetic circuit.

A second exemplary embodiment provides a solenoid system that includes the above-described solenoid device and a control unit that controls energization of the electromagnetic coils. When the dual-energized state is entered by the control unit, orientation of a current flowing to each of the first and second electromagnetic coils is prescribed such that the magnetic flux of the first electromagnetic coil and the magnetic flux of the second electromagnetic coil flow in a same direction in the third magnetic circuit.

In the above-described solenoid device and solenoid system, the magnetism limiting portion that limits magnetic flux is disposed in only the second magnetic circuit, of the first magnetic circuit and the second magnetic circuit. That is, the magnetism limiting portion is not formed in the first magnetic circuit. Therefore, magnetic resistance in the first magnetic circuit can be made low. Consequently, when only the first electromagnetic coil is energized, most of the magnetic flux of the first electromagnetic coil flows through the first magnetic circuit. The magnetic flux hardly flows through the other magnetic circuits such as the third magnetic circuit. As a result, energizing the second electromagnetic coil and canceling the magnetic flux of the first electromagnetic coil flowing through the third magnetic circuit by the magnetic flux of the second electromagnetic coil is no longer required. Consequently, stable attraction of only the first plunger becomes possible.

In the above-described solenoid device and solenoid system, the magnetism limiting portion is formed in the second magnetic circuit. Therefore, magnetic resistance in the second magnetic circuit can be increased. A portion of the magnetic flux of the second electromagnetic coil can be sufficiently sent to the third magnetic circuit in the dual-energized state. As a result, when, from the dual-energized state, energization of the first electromagnetic coil is stopped while maintaining energization of the second electromagnetic coil, the magnetic flux of the second electromagnetic coil can be sufficiently sent to the third magnetic circuit. Consequently, the first and second plungers can be continuously attracted. In addition, in this state, energization of the first electromagnetic coil is stopped. Therefore, power consumption can be suppressed.

As described above, the present disclosure may provide a solenoid device that is capable of stably attracting only either of two plungers and reducing power consumption when attracting both plungers, and a solenoid system in which the solenoid device is used.

The above-described "magnetic flux of the first electromagnetic coil" refers to magnetic flux that is generated as a result of the first electromagnetic coil being energized. This similarly applies to the above-described "magnetic flux of the second electromagnetic coil."

DESCRIPTION OF THE EMBODIMENTS

Embodiments of solenoid device will hereinafter be described with reference to the drawings. In the following embodiments, a solenoid device can be used as an on-board solenoid device that is mounted in a vehicle, such as an electric car or a hybrid car.

First Embodiment

A solenoid device and a solenoid system according to a first embodiment will be described with reference to FIGS. 1 to 11.

Figure 1:
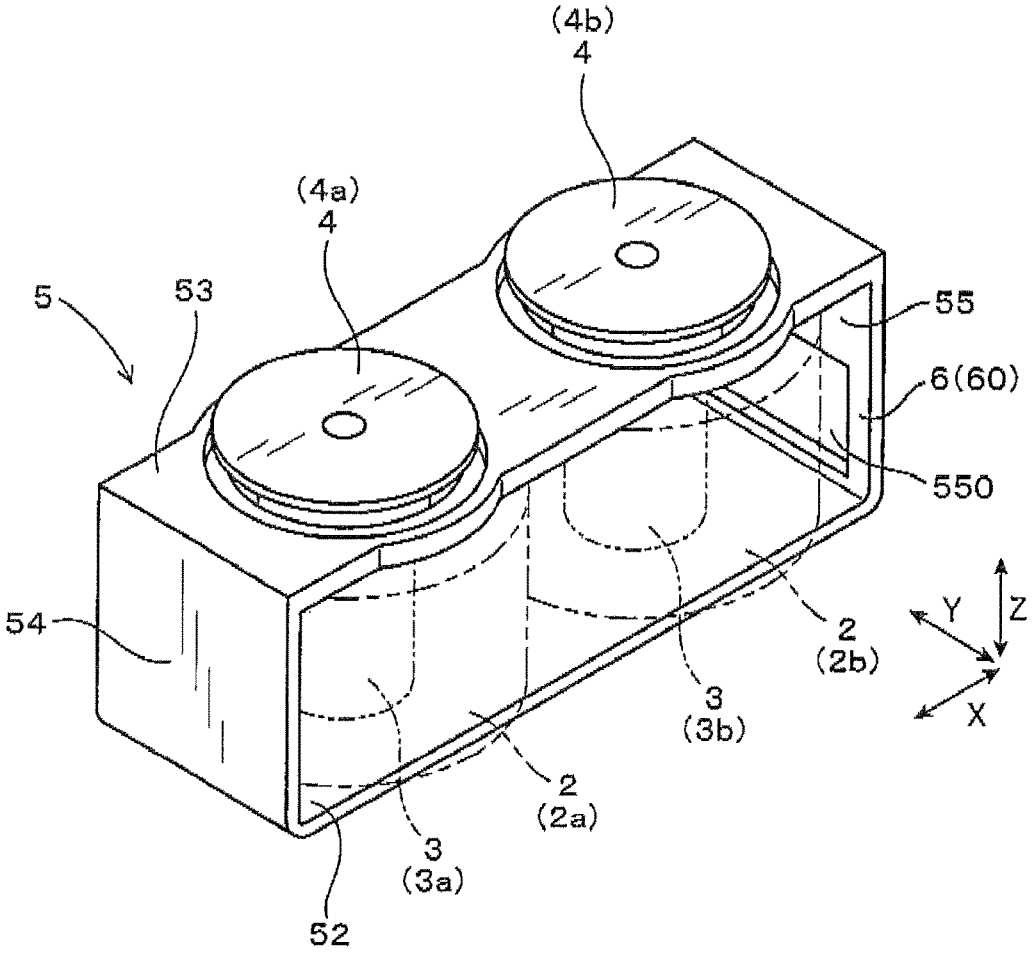
FIG. 1 is a perspective view of a section of a solenoid device according to a first embodiment.
Figure 2:
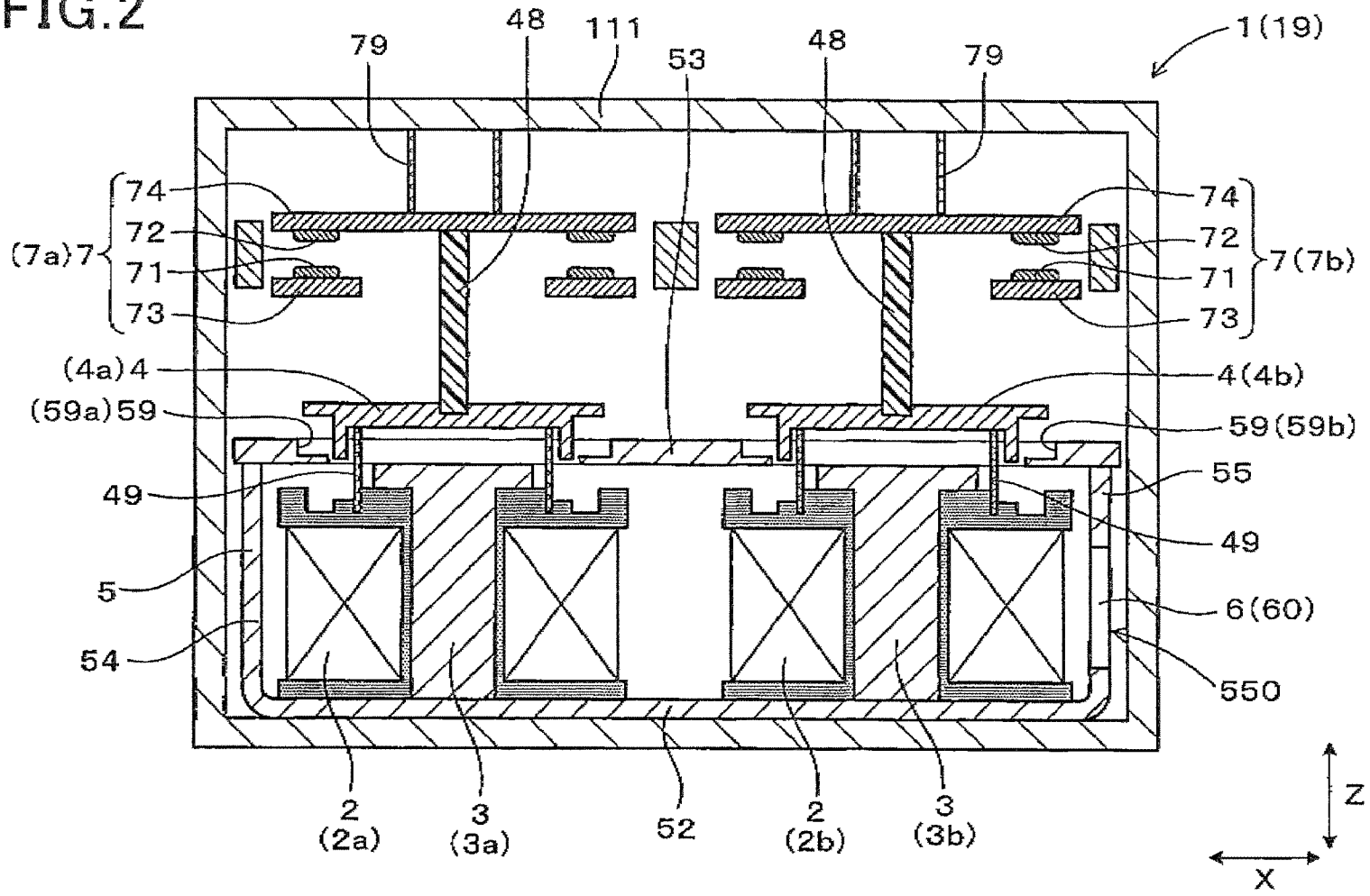
FIG. 2 is a cross-sectional view of the solenoid device in a dual-deenergized state, according to the first embodiment.

As shown in FIGS. 1 and 2, the solenoid device 1 according the present embodiment includes two electromagnetic coils 2, two stationary cores 3, two plungers 4, and a yoke 5. The two electromagnetic coils 2 are configured by a first electromagnetic coil 2*a* and a second electromagnetic coil 2*b* that are arranged side by side in a predetermined direction (hereinafter referred to as an arrangement direction). The two stationary cores 3 are configured by a first stationary core 3*a* and a second stationary core 3*b*. The two plungers 4 are configured by a first plunger 4*a* and a second plunger 4*b* that are movable in a predetermined direction (hereinafter referred to a forward-backward direction).

In the following drawings, three directions, i.e., X, Y, and Z directions orthogonal to one another, are shown for convenience of explanation. Z direction corresponds to the forward-backward direction of the respective plungers 4. X direction corresponds to the arrangement direction of the two electromagnetic coils 2. Y direction corresponds to a direction that is perpendicular to the arrangement direction of the two electromagnetic coils 2 and perpendicular to the forward-backward direction of the respective plungers 4.

The first electromagnetic coil 2*a* is energized to generate magnetic flux. The second electromagnetic coil 2*b* is energized to generate magnetic flux. The first stationary core 3*a* is disposed within the first electromagnetic coil 2*a*. The second stationary core 3*b* is disposed within the second electromagnetic coil 2*b*. The first plunger 4*a* is attracted to the first stationary core 3*a* by energization of the first electromagnetic coil 2*a*. The second plunger 4*b* is attracted to the second stationary core 3*b* by energization of the second electromagnetic coil 2*b*. The yoke 5 surrounds the two electromagnetic coils 2, that is, the first electromagnetic coil 2*a* and the second electromagnetic coil 2*b*.

As shown in FIG. 2, in a dual-deenergized state in which neither of the two electromagnetic coils 2 is energized, the first plunger 4*a* is separated from the first stationary core 3*a*. The second plunger 4*b* is separated from the second stationary core 3*b*.

Figure 3:
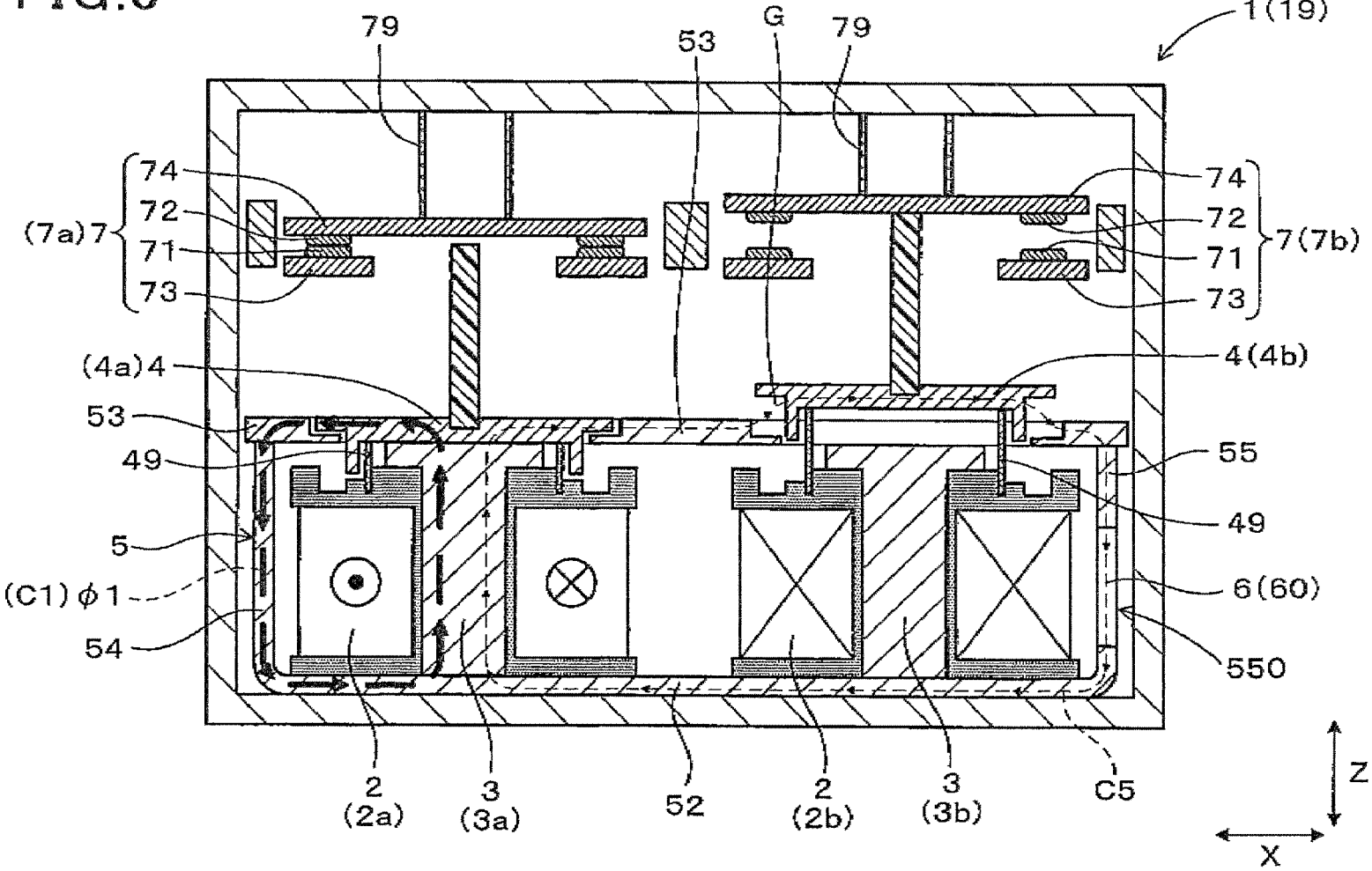
FIG. 3 is a cross-sectional view of the solenoid device in a case in which the dual-deenergized state is changed to a state in which only a first electromagnetic coil is energized, according to the first embodiment.

As shown in FIG. 3, when the dual-deenergized state is changed to a state in which only the first electromagnetic coil 2*a*, of the two electromagnetic coils 2, is energized, magnetic flux φ1 of the first electromagnetic coil 2*a* flows through a first magnetic circuit C1. The first magnetic circuit C1 includes only the first stationary core 3*a* of the two stationary cores 3, that is, the first stationary core 3*a* and the second stationary core 3*b*. As a result, the first plunger 4*a* is attracted to the first stationary core 3*a* while a state in which the second plunger 4*b* is separated from the second stationary core 3*b* is maintained.

Figure 4:
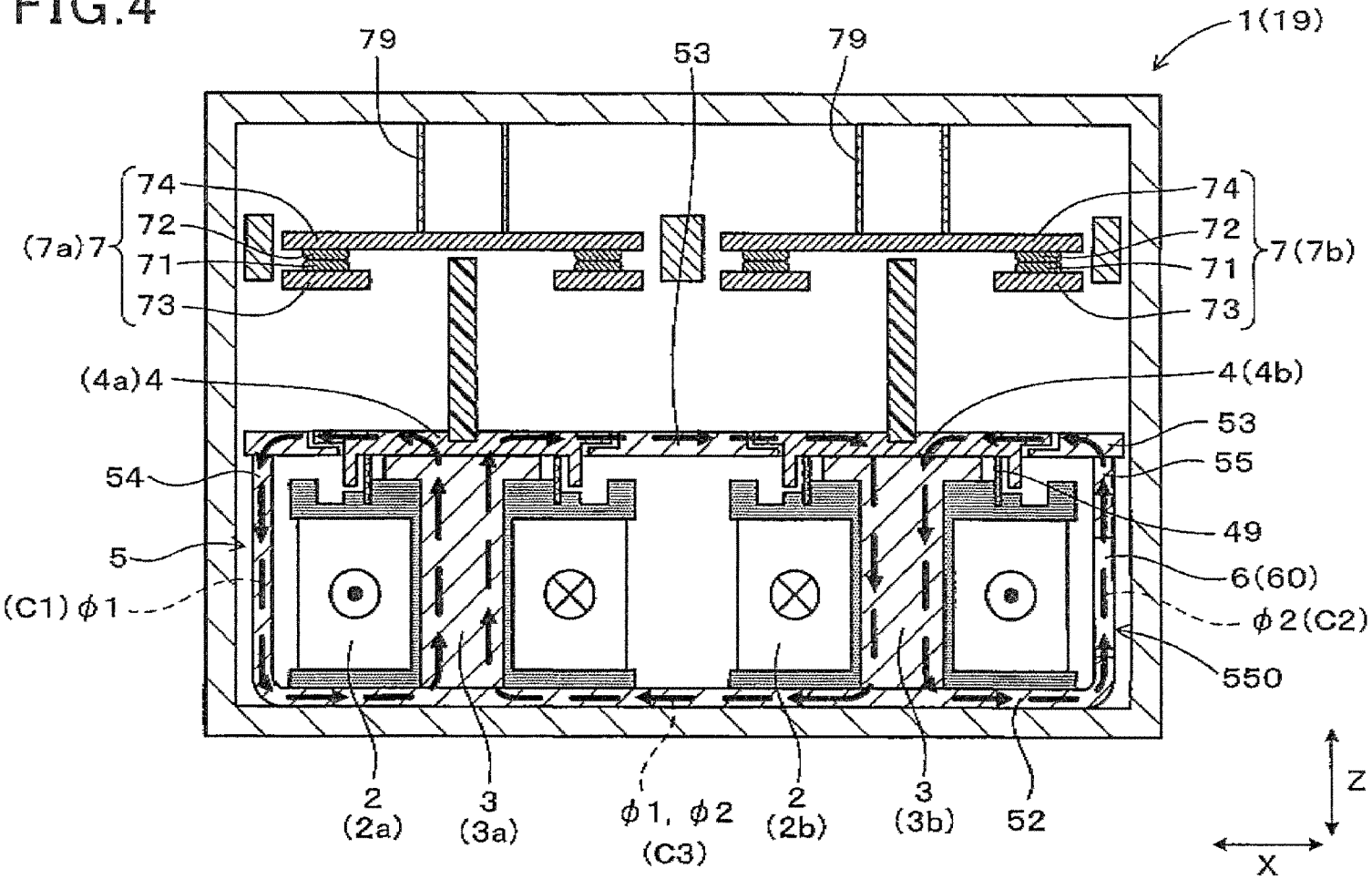
FIG. 4 is a cross-sectional view of the solenoid device in a dual-energized state, according to the first embodiment.

As shown in FIG. 4, in a dual-energized state in which both of the two electromagnetic coils 2 are energized, the magnetic flux φ1 of the first electromagnetic coil 2*a* flows through the first magnetic circuit C1. In addition, magnetic flux φ2 of the second electromagnetic coil 2*b* flows through a second magnetic circuit C2. The second magnetic circuit C2 includes only the second stationary core 3*b* of the two stationary cores 3*a* and 3*b*. As a result of a magnetic force that is thereby generated, the first plunger 4*a* is attracted to the first stationary core 3*a* and the second plunger 4*b* is attracted to the second stationary core 3*b*. In addition, the magnetic fluxes φ1 and φ2 respectively generated from the two electromagnetic coils 2*a* and 2*b* flow through a third magnetic circuit C3. The third magnetic circuit C3 includes the two stationary cores 3*a* and 3*b*.

Figure 5:
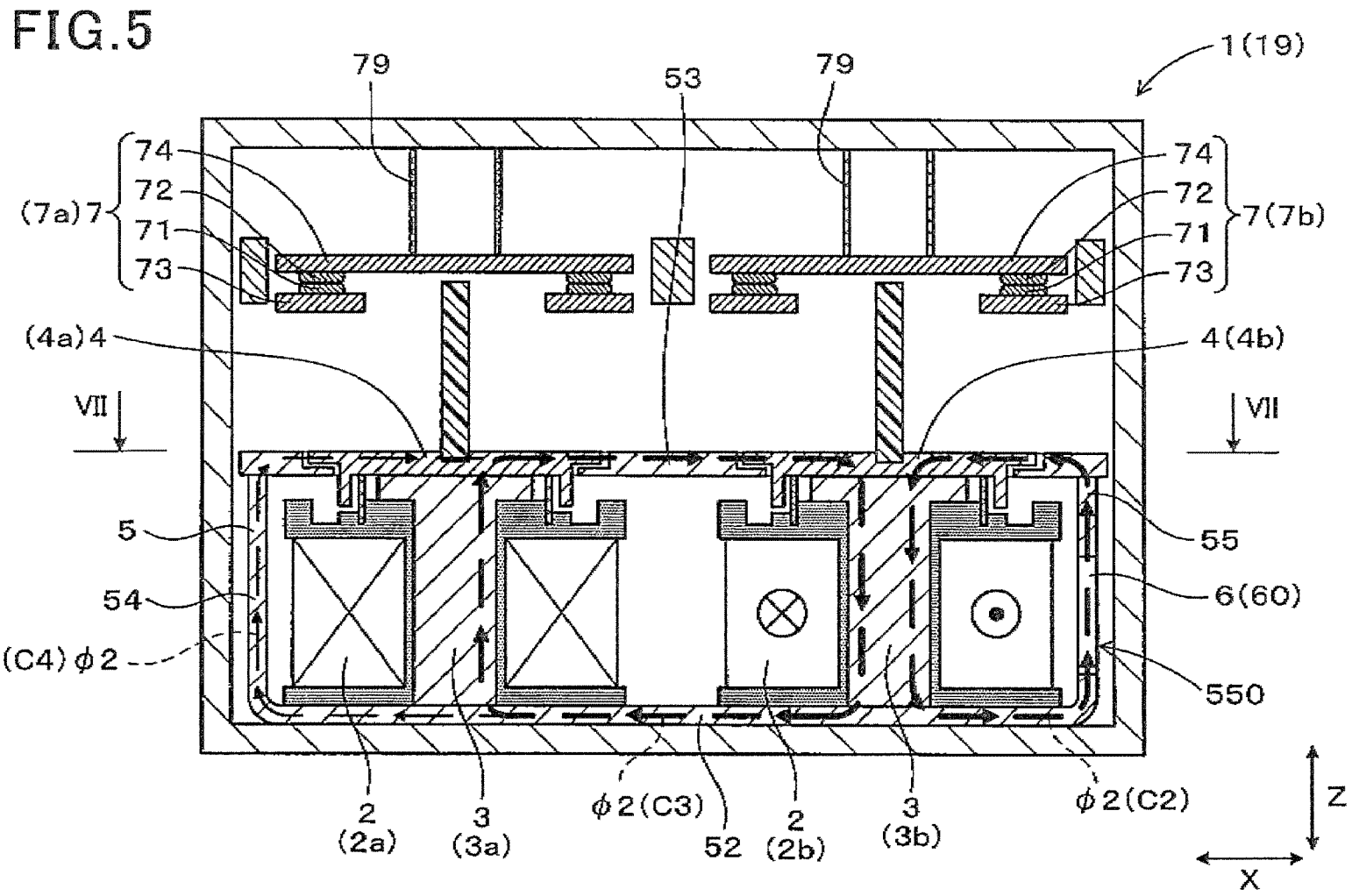
FIG. 5 is a cross-sectional view of the solenoid device in a state in which energization of the first electromagnetic coil is stopped after the dual-energized state.

As shown in FIG. 5, from the dual-energized state, when energization of the first electromagnetic coil 2*a* is stopped while maintaining energization of the second electromagnetic coil 2*b*, the magnetic flux φ2 of the second electromagnetic coil 2*b* continues to flow through the second magnetic circuit C2 and the third magnetic circuit C3. As a result of the magnetic force thereby generated, a dual-attracting state in which the first plunger 4*a* is attracted to the first stationary core 3*a* and the second plunger 4*b* is attracted to the second stationary core 3*b* is maintained.

A magnetism limiting portion 6 is formed in only the second magnetic circuit C2, of the first magnetic circuit C1 and the second magnetic circuit C2. The magnetism limiting portion 6 limits magnetic flux. In addition, the magnetism limiting portion 6 is formed in a portion of the second magnetic circuit C2 that does not overlap the third magnetic circuit C3.

The solenoid device 1 of the present embodiment is an on-board solenoid device that is mounted in a vehicle, such as an electric car or a hybrid car. The solenoid device 1 is used in a relay 19. Two switches 7, that is, a first switch 7*a* and a second switch 7*b*, are disposed in the relay 19. The first switch 7*a* is turned ON and OFF by moving the first plunger 4*a* in the forward-backward direction (Z direction). The second switch 7*b* is turned ON and OFF by moving the second plunger 4*b* in the forward-backward direction (Z direction).

As described above, the first magnetic circuit C1 is a magnetic circuit that includes only the first stationary core 3*a*, of the two stationary cores 3*a* and 3*b*. As shown in FIG. 3, as the magnetic circuits including only the first stationary core 3*a*, there is a magnetic circuit (first magnetic circuit C1) in which the magnetic flux φ1 of the first electromagnetic coil 2*a* passes through a first side wall portion 54 and a magnetic circuit (fifth magnetic circuit C5) in which the magnetic flux φ1 passes through a second side wall portion 55.

The first side wall portion 54 configures the yoke 5 and is adjacent to the first electromagnetic coil 2*a*. The second side wall portion 55 configures the yoke 5 and is adjacent to the second electromagnetic coil 2*b*. However, the fifth magnetic circuit C5 has a long path length and a high magnetic resistance. Therefore, only a small amount of magnetic flux φ1 flows through the fifth magnetic circuit C5. In the present specification, the "first magnetic circuit C1" refers to the magnetic circuit that includes only the first stationary core 3*a*, of the two stationary cores 3*a* and 3*b*, and in which the magnetic flux φ1 flows through the first side wall portion 54, or in other words, that has a relatively short path length.

As described above, the second magnetic circuit C2 is a magnetic circuit that includes only the second stationary core 3*b*, of the two stationary cores 3*a* and 3*b*. As shown in FIG. 5, as the magnetic circuits including only the second stationary core 3*b*, there is a magnetic circuit (second magnetic circuit C2) in which the magnetic flux φ2 of the second electromagnetic coil 2*b* passes through the second side wall portion 55 and a magnetic circuit (fourth magnetic circuit C4) in which the magnetic flux φ2 passes through the first side wall portion 54. In the present specification, the "second magnetic circuit C2" refers to the magnetic circuit that includes only the second stationary core 3*b*, of the two stationary cores 3*a* and 3*b*, and in which the magnetic flux φ2 flows through the second side wall portion 55, or in other words, that has a relatively short path length.

Figure 8:
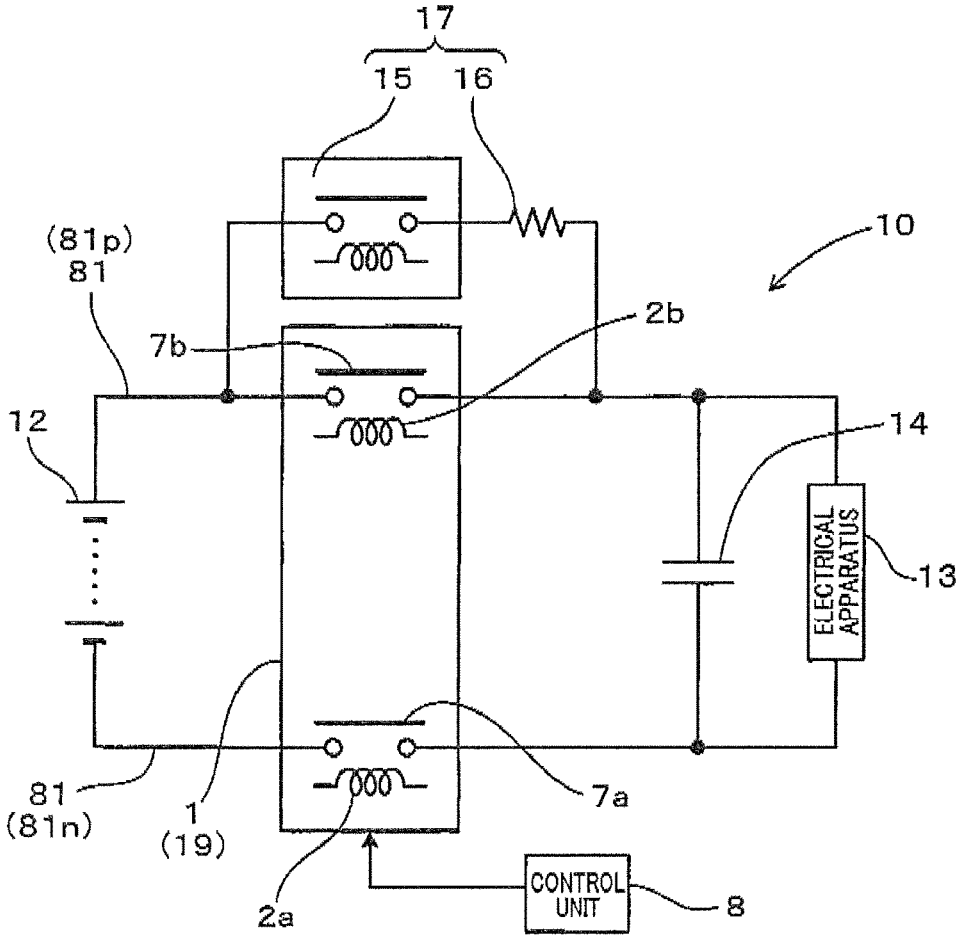
FIG. 8 is a circuit diagram of a solenoid system in the dual-deenergized state according to the first embodiment.

As shown in FIG. 8, the solenoid device 1 according to the present embodiment is provided on a pair of power lines 81 (81*p* and 81*n*) connecting a direct-current power supply 12 and an electrical apparatus 13. The power lines 81 are a positive-side power line 81*p* and a negative-side power line 81*n*. The positive-side power line 81*p* connects a positive electrode of the direct-current power supply 12 and the electrical apparatus 13. The negative-side power line 81*n* connects a negative electrode of the direct-current power supply 12 and the electrical apparatus 13. The first switch 7*a* is provided on the negative-side power line 81*n*. The second switch 7*b* is provided on the positive-side power line 81*p*.

A serial connection body 17 is connected in parallel with the second switch 7*b*. In the serial connection body 17, a pre-charge relay 15 and a pre-charge resistor 16 are connected in series. A capacitor 14 for smoothing is connected in parallel to the electrical apparatus 13. The electrical apparatus 13 is a power converter that converts direct-current power supplied from the direct-current power supply 12 to alternating-current power. According to the present embodiment, the power converter converts the direct-current power from the direct-current power supply 12 to alternating-current power, and an alternating current motor (not shown) is driven. As a result, the vehicle is able to run.

Figure 9:
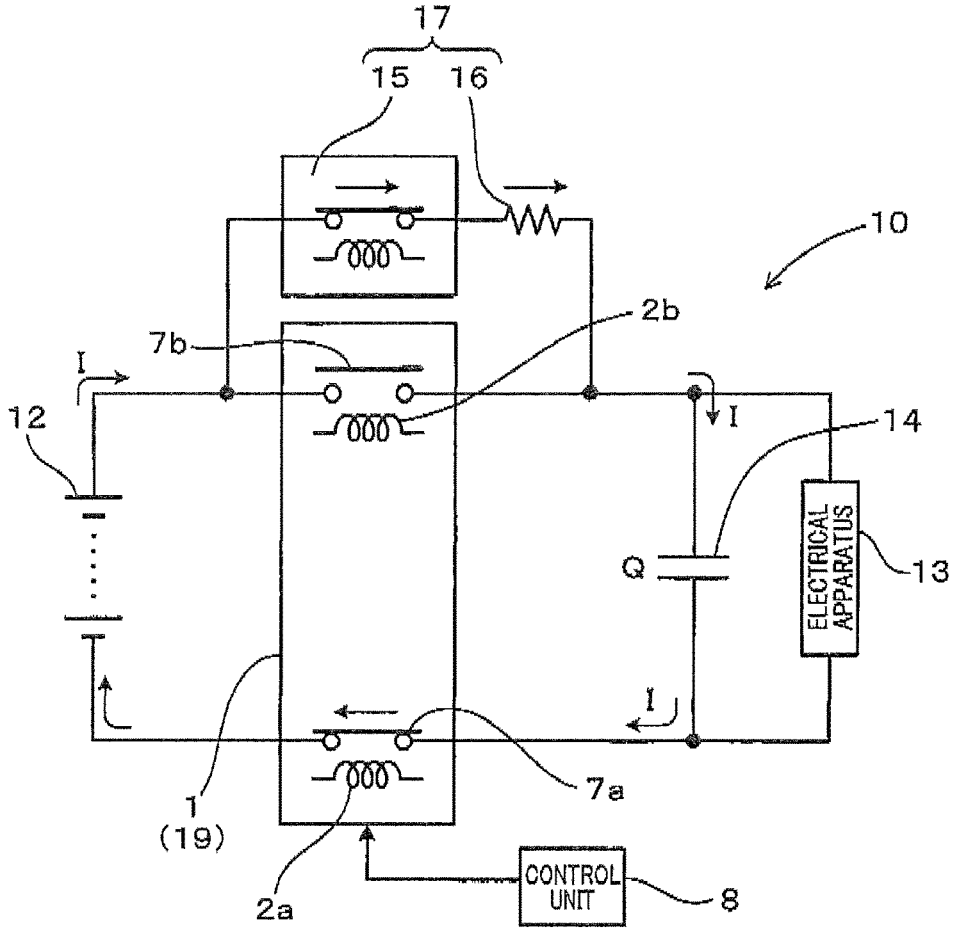
FIG. 9 is a circuit diagram of the solenoid system in a state in which only a first switch is turned ON and a capacitor is pre-charged, according to the first embodiment.

When the electrical apparatus 13 is operated, should the two switches 7*a* and 7*b* be simultaneously turned ON in a state in which the capacitor 14 is not charged, inrush current may flow and the switches 7*a* and 7*b* may become fused. Therefore, according to the present embodiment, before the electrical apparatus 13 is operated, the first switch 7*a* and the pre-charge relay 15 are turned ON while the second switch 7*b* is turned OFF, as shown in FIG. 9. A current I is gradually supplied to the capacitor 14 via the pre-charge resistor 16. As a result, the capacitor 14 is gradually charged, and the flow of inrush current is prevented.

Figure 10:
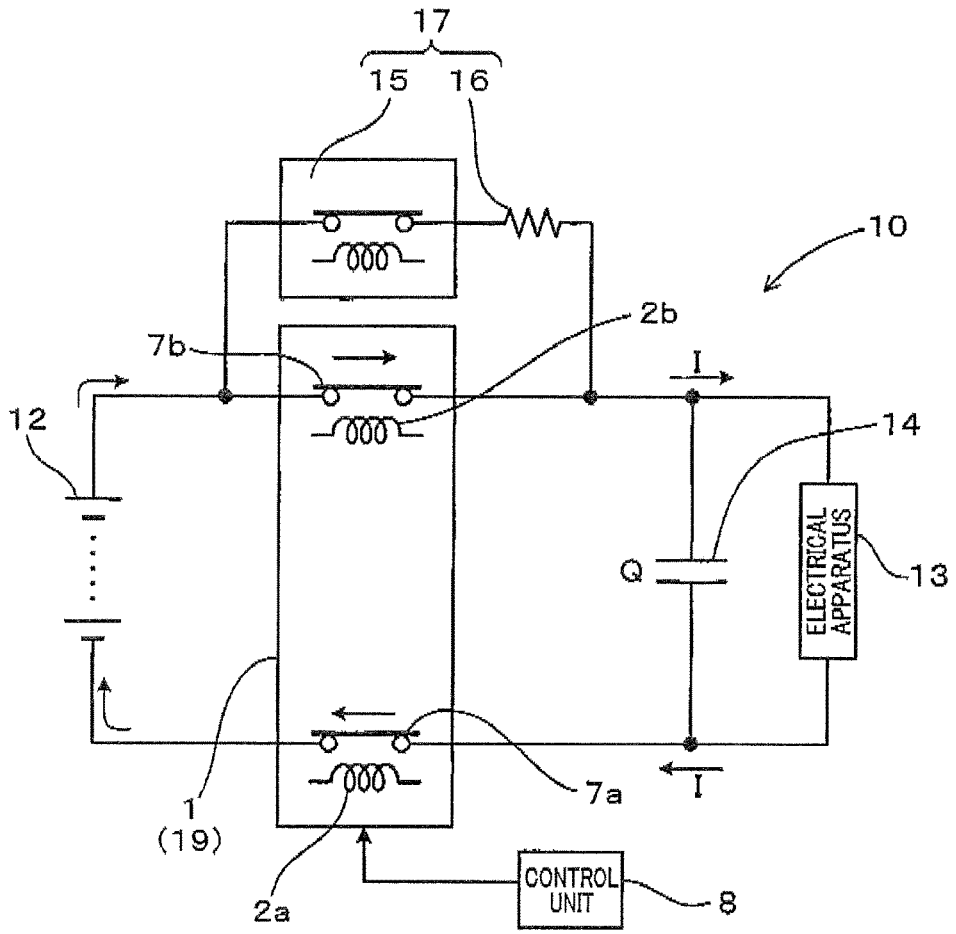
FIG. 10 is a circuit diagram of the solenoid system in a dual-attracting state after the state in FIG. 9.
Figure 11:
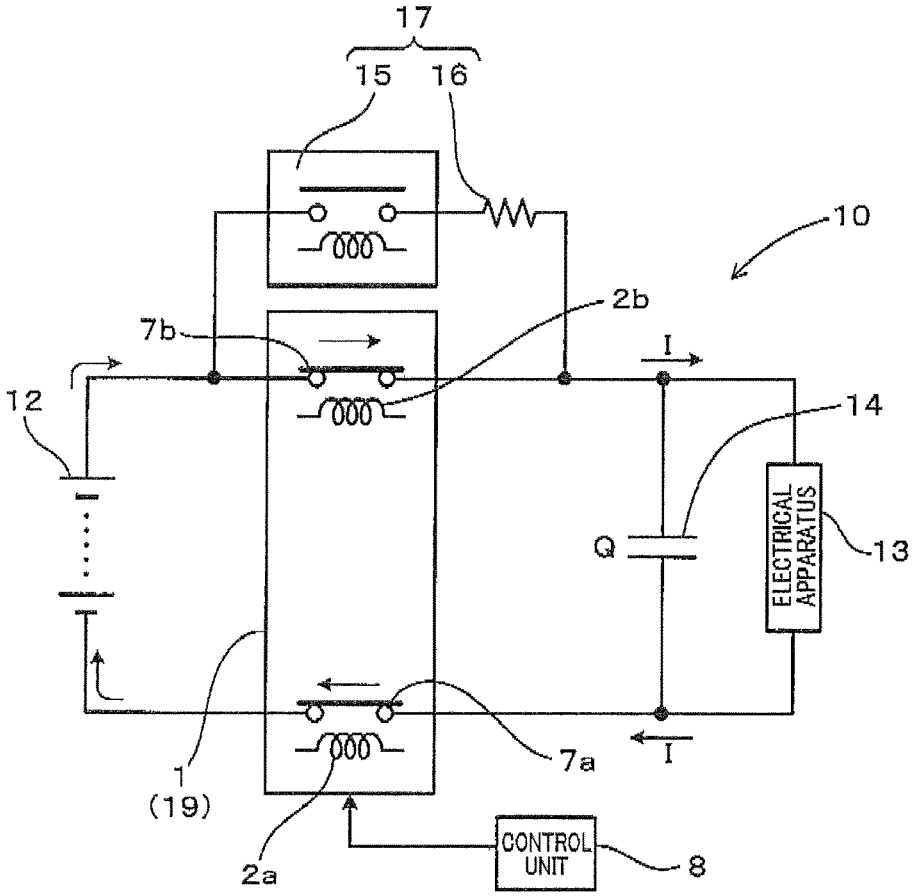
FIG. 11 is a circuit diagram of the solenoid system in a state in which a pre-charge relay is turned OFF and power is supplied to an electrical apparatus after FIG. 10.

After charging of the capacitor 14 is completed, as shown in FIG. 10, the second switch 7*b* is turned ON. Next, as shown in FIG. 11, the pre-charge relay 15 is turned OFF. As a result, direct-current power is supplied to the electrical apparatus 12 in a state in which the two switches 7*a* and 7*b* are turned ON.

To perform the above-described operation, the solenoid device 1 according to the present embodiment is configured such as to be capable of attracting only the first plunger 4*a* (turning ON only the first switch 7*a*), as well as attracting both of the two plungers 4*a* and 4*b* (turning ON the two switches 7*a* and 7*b*). In addition, the amount of time over which the two plungers 4*a* and 4*b* are attracted, that is, the amount of time over which both of the two switches 7*a* and 7*b* are turned ON and power is supplied to the electrical apparatus 13 is long. Therefore, as described hereafter, the solenoid device 1 is capable of attracting both of the two plungers 4*a* and 4*b* by merely energizing the second electromagnetic coil 2*b*. Power consumption is reduced.

As shown in FIGS. 8 to 11, a control unit S is connected to the solenoid device 1 (relay 19) and the pre-charge relay 15. The control unit 8 controls energization of the two electromagnetic coils 2*a* and 2*b*. A solenoid system 10 is configured by the solenoid device 1 and the control unit 8.

As shown in FIGS. 1 and 2, the yoke 5 includes a bottom wall portion 52, an upper wall portion 53, the first side wall portion 54, and the second side wall portion 55. The two electromagnetic coils 2*a* and 2*b* are placed on the bottom wall portion 52. In addition, the stationary cores 3*a* and 3*b* are connected to the bottom wall portion 52. Hole portions 59 (59*a* and 59*b*) into which the plungers 4*a* and 4*b* are fitted are formed in the upper wall portion 53. As described above, the first side wall portion 54 is formed in a position adjacent to the first electromagnetic coil 2*a*. The second side wall portion 54 is formed in a position adjacent to the second electromagnetic coil 2*b*. As shown in FIG. 1, a through hole 550 is formed in the second side wall portion 55. A portion of the second side wall portion 55 that is adjacent to the through hole 550 serves as the magnetism limiting portion 6.

The magnetism limiting portion 6 according to the present embodiment is composed of a portion of the yoke 5. The magnetism limiting portion 6 is a magnetically-saturated portion 60 in which magnetism is at saturation.

"Magnetism is at saturation" indicates a state in which a magnetically saturated region of the B-H curve is entered. The magnetically saturated region can be defined as a region in which the density of magnetic flux is 50% or more of the density of saturated magnetic flux. In addition, the density of saturated magnetic flux refers to the density of magnetic flux of a magnetic material in a state in which an external magnetic field is applied to the magnetic material until the intensity of magnetism thereof no longer increases.

As shown in FIG. 1, according to the present embodiment, as a result of the through hole 550 being formed, a thin portion is formed in the second side wall portion 55 in a localized manner. This portion serves as the magnetically-saturated portion 60 (magnetism limiting portion 6). As a result of the magnetically-saturated portion 60 being formed such as to be thin in this way, magnetism more easily reaches saturation in the magnetically-saturated portion 60 that in other portions of the second magnetic circuit C2.

As shown in FIG. 2, the switch 7 includes a fixed contact 71, a movable contact 72, a fixed contact supporting portion 73, and a movable contact supporting portion 74. A contact-side spring member 79 is interposed between an upper plate 111 of a case 11 and the movable contact support portion 74. The movable contact support portion 74 is pressed toward the plunger 4 side by the contact-side spring member 79.

In addition, a bar-shaped portion 48 is provided in the plunger 4. A plunger-side spring member 49 is interposed between the plunger 4 and the electromagnetic coil 2. The plunger 4 is pressed toward the switch 7 side by the plunger-side spring member 49.

As shown in FIG. 3, when the first electromagnetic coil 2*a* is energized, the magnetic flux φ1 is generated and flows through the first magnetic circuit C1. The first magnetic circuit C1 is composed of the first stationary core 3*a*, the first plunger 4*a*, and the upper wall portion 53, the first side wall portion 54, and the bottom wall portion 52 of the yoke 5. When the magnetic flux φ1 flows through the first magnetic circuit C1, a magnetic force is generated and the first plunger 4*a* is attracted to the first stationary core 3*a*. Thus, the movable contact supporting portion 74 is pressed by the pressing force of the contact-side spring member 79. As a result, the first switch 7*a* is turned ON.

As described above, according to the present embodiment, the magnetism limiting portion 6 is formed in only the second magnetic circuit C2, of the first magnetic circuit C1 and the second magnetic circuit C2. That is, the magnetism limiting portion 6 is not formed in the first magnetic circuit C1. Therefore, the magnetic resistance in the first magnetic circuit C1 is low. In addition, in a state in which the second electromagnetic coil 2*b* is not energized, as shown in FIG. 3, the second plunger 4*b* is not attracted to the second stationary core 3*b*. A gap G is present between the upper wall portion 53 and the second plunger 4*b*. Therefore, the magnetic resistance in the third magnetic circuit C3 (see FIG. 4)

that includes this gap G is high. As a result, only the first plunger 4*a*, of the two plungers 4*a* and 4*b*, is attracted to the stationary core 3.

When each of the two electromagnetic coils 2*a* and 2*b* is energized, the magnetic flux 92 of the second electromagnetic coil 2*b* flows through the second magnetic circuit C2. The second magnetic circuit C2 is composed of the second stationary core 3*b*, the second plunger 4*b*, and the bottom wall portion 52, the second wall portion 55, and the upper wall portion 53 of the yoke 5. When the magnetic flux φ2 flows through the second magnetic circuit C2, a magnetic force is generated and the second plunger 4*b* is attracted to the second stationary core 3*b*. As a result, the second switch 7*b* is turned ON.

When the second plunger 4*b* is attracted to the second stationary core 3*b*, the gap G (see FIG. 3) between the upper wall portion 53 and the second plunger 4*b* becomes small. Therefore, the magnetic resistance in the third magnetic circuit C3 decreases. The respective magnetic fluxes φ1 and φ2 of the two electromagnetic coils 2*a* and 2*b* flow through the third magnetic circuit C3. According to the present embodiment, the orientation of the current flowing through each of the electromagnetic coils 2*a* and 2*b* is prescribed such that the magnetic flux φ1 of the first electromagnetic coil 2*a* and the magnetic flux φ2 of the second electromagnetic coil 2*b* flow in the same direction in the third magnetic circuit C3. Therefore, the magnetic fluxes φ1 and φ2 of the two electromagnetic coils 2*a* and 2*b* are strengthened in the third magnetic circuit C3. The magnetic force that attracts the two plungers 4*a* and 4*b* to the stationary cores 3 is further generated.

As described above, according to the present embodiment, the magnetism limiting portion 6 is formed in the second magnetic circuit C2. Therefore, the magnetic flux φ2 of the second electromagnetic coil 2*b* can be limited by the magnetism limiting portion 6 and excess magnetic flux φ2 can be sent to the third magnetic circuit C3.

After the two electromagnetic coils 2*a* and 2*b* are energized in this way, as shown in FIG. 5, energization of the first electromagnetic coil 2*a* is stopped while maintaining energization of the second electromagnetic coil 2*b*. As a result, the magnetic flux φ1 of the first electromagnetic coil 2*a* dissipates, and the magnetic flux φ2 of the second electromagnetic coil 2*b* continues to flow through the third magnetic circuit C3. Therefore, the two plungers 4*a* and 4*b* can be continuously attracted to the stationary cores 3. Consequently, the two switches 7*a* and 7*b* can be continuously turned ON. At this time, energization of the first electromagnetic coil 2*a* is stopped. Thus, the two plungers 4*a* and 4*b* can be continuously attracted to the stationary cores 3 while reducing power consumption of the solenoid device 1.

Figure 7:
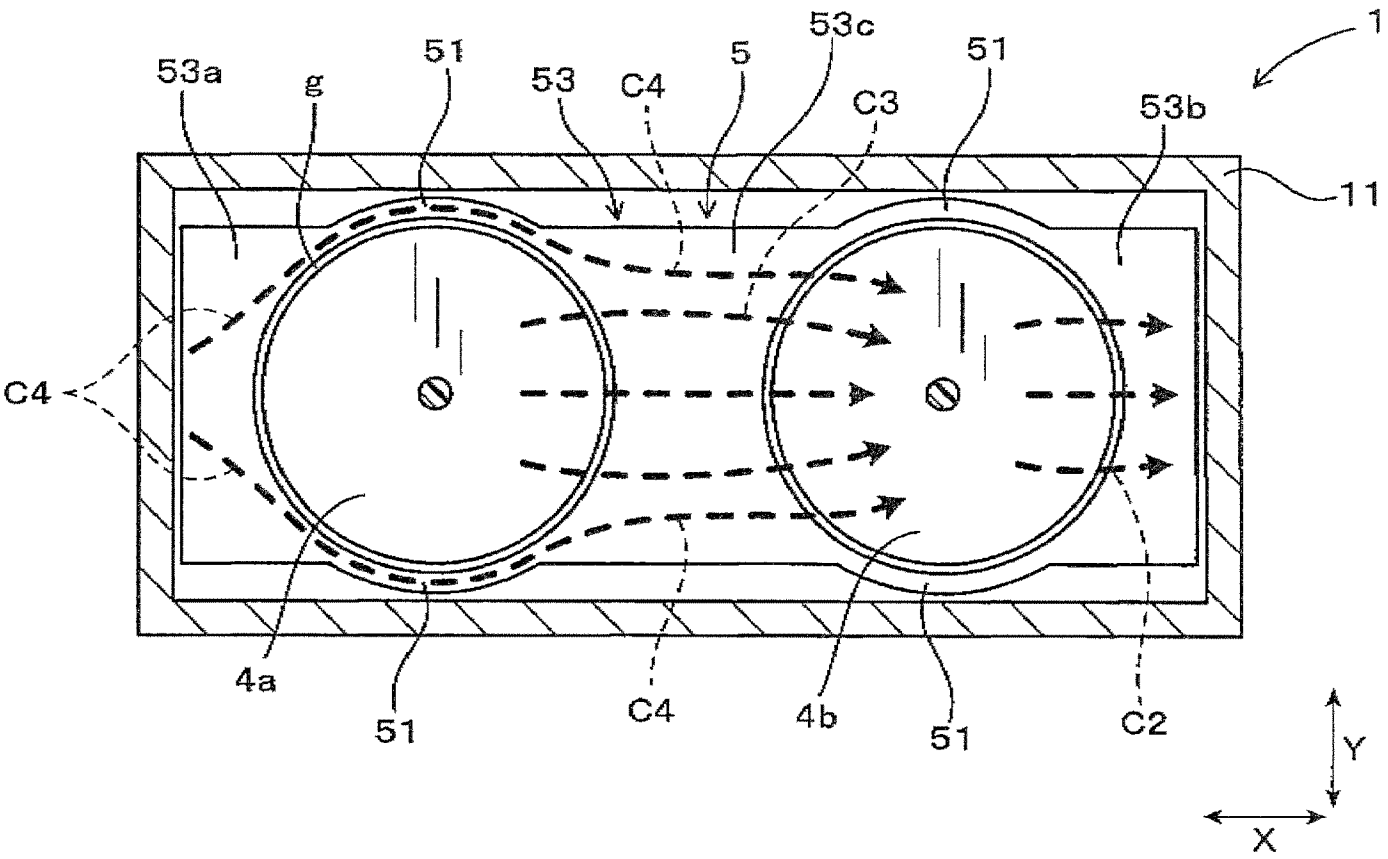
FIG. 7 is a cross-sectional view taken along VII-VII in FIG. 5.

As shown in FIG. 5, a portion of the magnetic flux φ2 of the second electromagnetic coil 2*b* also flows through the fourth magnetic circuit C4. As shown in FIGS. 5 and 7, the fourth magnetic circuit C4 is composed of the second stationary core 3*b*, the second plunger 4*b*, and the bottom wall portion 52, the first side wall portion 54, and the upper wall portion 53 of the yoke 5. The fourth magnetic circuit C4 partially overlaps the first magnetic circuit C1 (see FIG. 3) and the third magnetic circuit C3. The fourth magnetic circuit C4 does not include the first stationary core 3*a*.

Therefore, even when the magnetic flux φ2 flows through the fourth magnetic circuit C4, the magnetic force that attracts the first plunger 4*a* to the first stationary core 3*a* is not generated. As shown in FIG. 7, according to the present embodiment, an auxiliary magnetism limiting portion 51 is formed in the fourth magnetic circuit C4. As a result, the magnetic resistance in the fourth magnetic circuit C4 is increased, and the amount of magnetic flux φ2 flowing through the fourth magnetic circuit C4 is reduced. Consequently, the amount of magnetic flux φ2 flowing through the second magnetic circuit C2 and the third magnetic circuit C3 is increased, and the magnetic force that attracts the two plungers 4*a* and 4*b* to the stationary cores 3 is strengthened.

The auxiliary magnetism limiting portion 51 is formed in a position on the fourth magnetic circuit 4 that does not overlap the first magnetic circuit C1 and the third magnetic circuit C3. Should the auxiliary magnetism limiting portion 51 be formed in a position overlapping the first magnetic circuit C1, the magnetic resistance in the first magnetic circuit C1 increases. A sufficient flow of magnetic flux φ1 to the first magnetic circuit C1 becomes difficult to achieve when only the first electromagnetic coil 2*a* is energized (see FIG. 3). Therefore, the attraction force on the first plunger 4 may decrease.

In addition, should the auxiliary magnetism limiting portion 51 be formed in a position overlapping the third magnetic circuit C3, the magnetic resistance in the third magnetic circuit C3 increases. A sufficient magnetic force may not be generated when the magnetic flux φ2 flows through the third magnetic circuit C3 (see FIG. 5) and the two plungers 4*a* and 4*b* are attracted to the stationary cores 3. For the foregoing reasons, according to the present embodiment, the auxiliary magnetism limiting portion 51 is formed in a position on the fourth magnetic circuit C4 that does not overlap the first magnetic circuit C1 and the third magnetic circuit C3.

Figure 6:
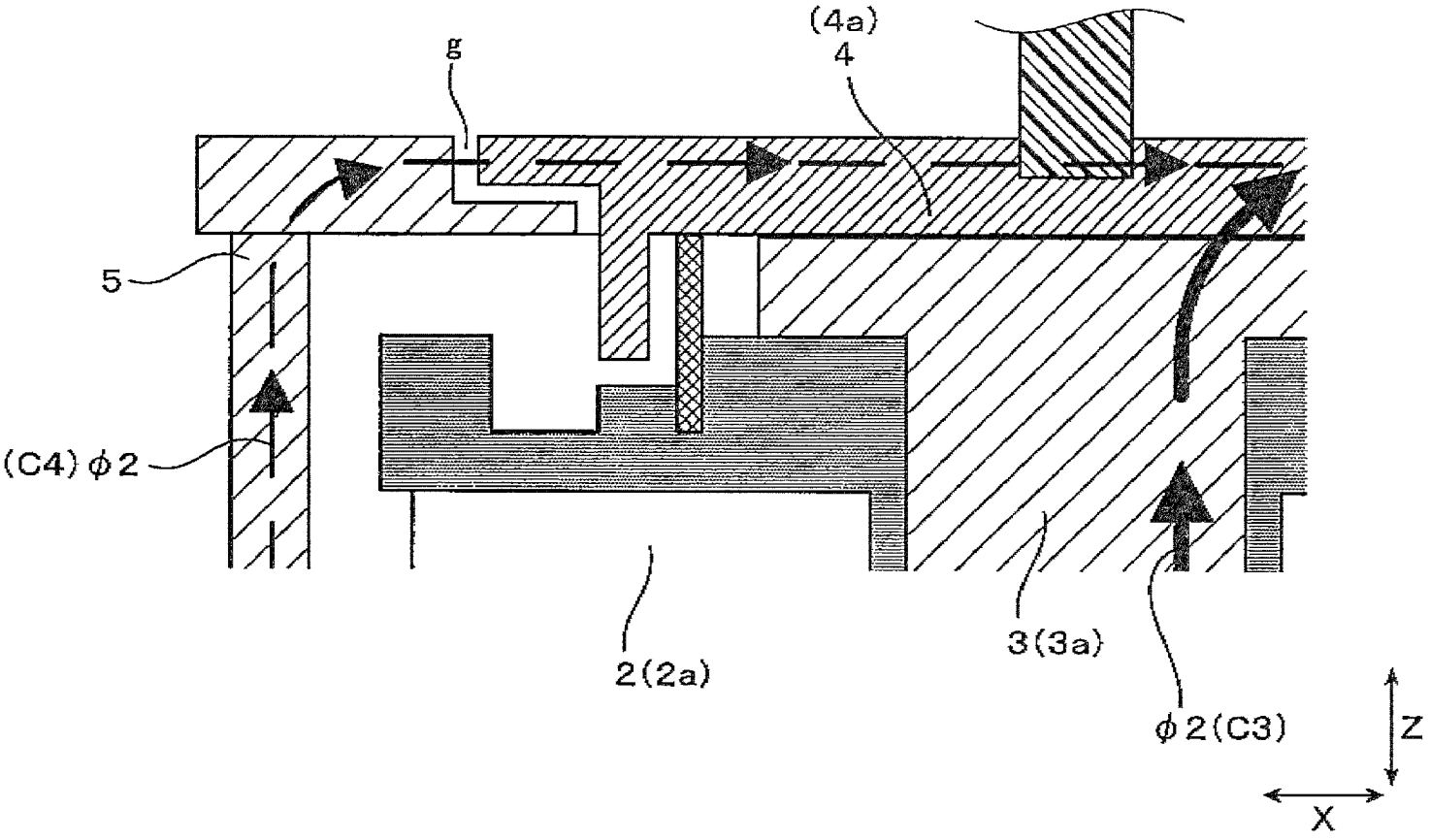
FIG. 6 is an enlarged cross-sectional view of a main section in FIG. 5.

As shown in FIG. 7, the upper wall portion 53 includes a first portion 53*a*, a second portion 53*b*, and a third portion 53*c*. The first portion 53*a* configures the first magnetic circuit C1 (see FIG. 5). The second portion 53*b* configures the second magnetic circuit C2. The third portion 53*c* is interposed between the two plungers 4*a* and 4*b*. The auxiliary magnetism limiting portion 51 is formed in a section connecting the first portion 53*a* and the third portion 53*c*. As shown in FIGS. 6 and 7, a slight gap g is formed between the first plunger 4*a* and the upper wall portion 53. Magnetic resistance is high. Therefore, when the magnetic flux φ2 flows from the first portion 53*a* to the third portion 53*c*, the magnetic flux 92 flows through the auxiliary magnetism limiting portion 51 without passing through the first plunger 4*a*.

As shown in FIG. 7, the auxiliary magnetism limiting portion 51 is configured by a portion of the yoke 5. Magnetism is at saturation in the auxiliary magnetism limiting portion 51.

As described above, according to the present embodiment, as shown in FIG. 5, the two switches 7*a* and 7*b* are turned ON, and power is supplied to the electrical apparatus 13 (see FIG. 8). To subsequently stop the power supply, energization of the second electromagnetic coil 2*b* is stopped as shown in FIG. 2. As a result, the magnetic flux φ2 dissipates and the magnetic force that attracts the plungers 4*a* and 4*b* to the stationary cores 3 dissipates. Consequently, the plungers 4 are pressed toward the switch 7 side by the pressing force of the plunger-side spring members 49. Then, the bar-shaped portions 48 come into contact with the movable contact supporting portions 74 and the movable contacts 72 separate from the fixed contacts 71. Therefore, the switches 7*a* and 7*b* are turned OFF.

Next, working effects according to the present embodiment will be described. According to the present embodiment, as shown in FIG. 3, the magnetism limiting portion 6 is formed in only the second magnetic circuit C2, of the first magnetic circuit C1 and the second magnetic circuit C2. That is, the magnetism limiting portion 6 is not formed in the first magnetic circuit C1.

Therefore, the magnetic resistance in the first magnetic circuit C2 can be made low. Consequently, when only the first electromagnetic coil 2*a* is energized, most of the magnetic flux φ1 of the first electromagnetic coil 2*a* flows to the first magnetic circuit C1. The magnetic flux φ1 hardly flows to the other magnetic circuits such as the third magnetic circuit C3. As a result, energizing the second electromagnetic coil 2*b* and canceling the magnetic flux φ1 of the first electromagnetic coil 2*a* flowing through the third magnetic circuit C3 by the magnetic flux φ2 of the second electromagnetic coil 2*b* is no longer required. Consequently, stable attraction of only the first plunger 4*a* becomes possible.

Figure 14:
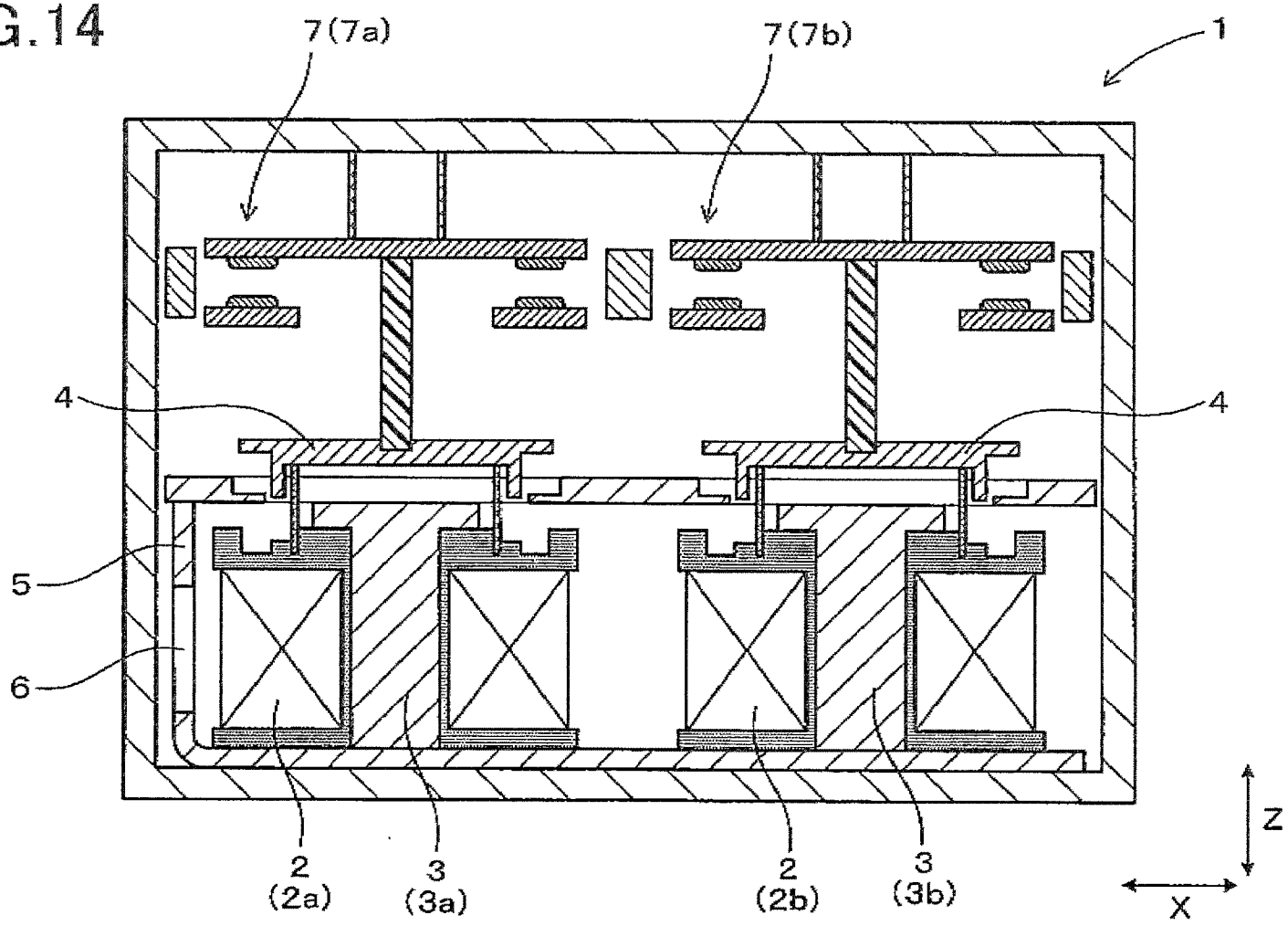
FIG. 14 is a cross-sectional view of a solenoid device in a dual-deenergized state in a comparison example.
Figure 15:
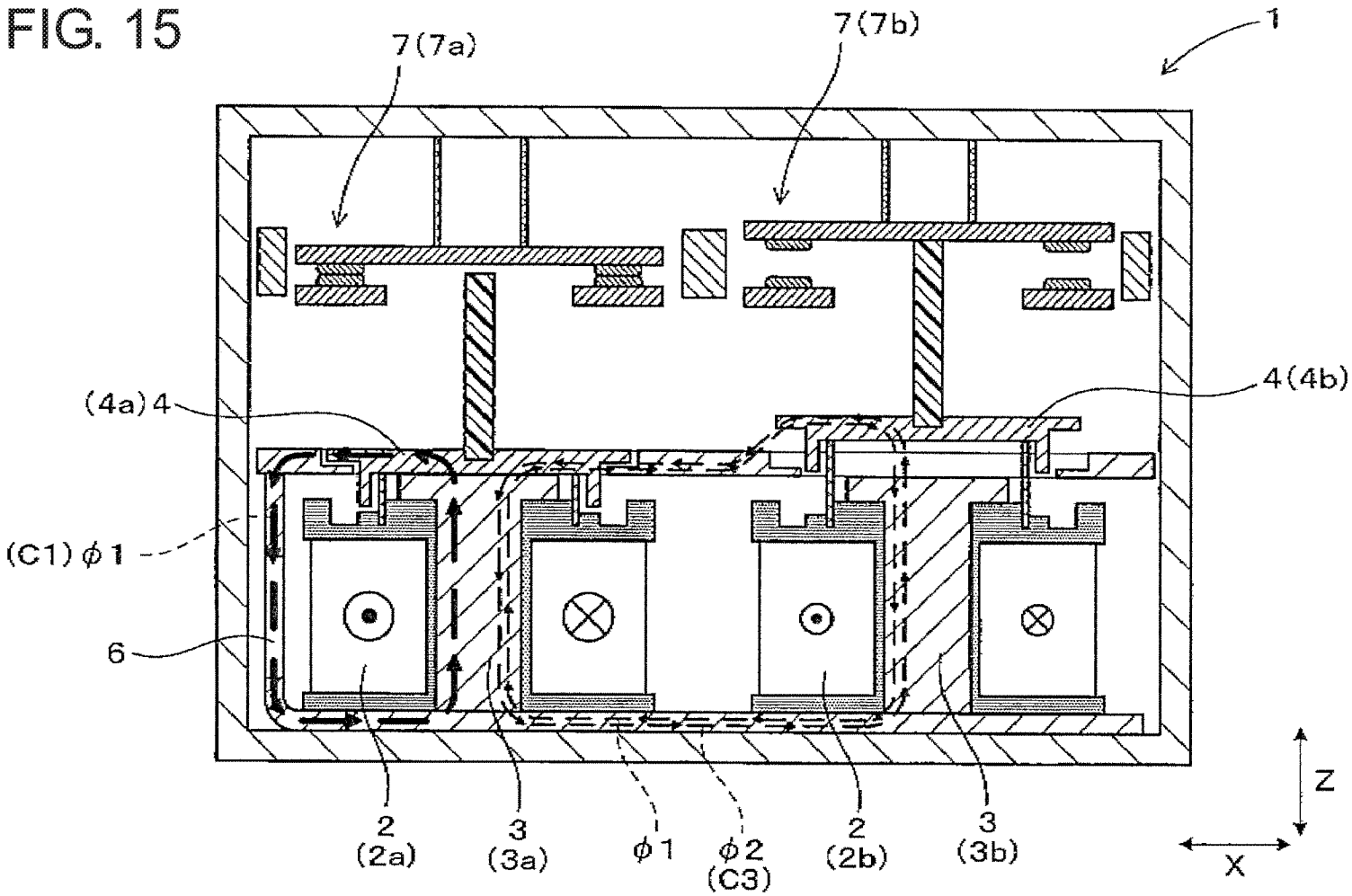
FIG. 15 is a cross-sectional view of the solenoid device in a state in which only the first plunger is attracted, in the comparison example.

Conventionally, as shown in FIGS. 14 and 15, the magnetism limiting portion 6 is formed in the first magnetic circuit C1 and the magnetic resistance in the first magnetic circuit C1 is increased. As a result, as shown in FIG. 15, the magnetic flux φ1 of the first electromagnetic coil 2*a* is sent not only through the first magnetic circuit C1, but also the third magnetic circuit C3 (shared magnetic circuit). When only the first plunger 4*a* is attracted, the two electromagnetic coils 2*a* and 2*b* are energized and the magnetic flux φ1 of the first electromagnetic coil 2*a* flowing through the third magnetic circuit C3 is canceled by the magnetic flux φ2 of the second electromagnetic coil 2*b*.

Figure 16:
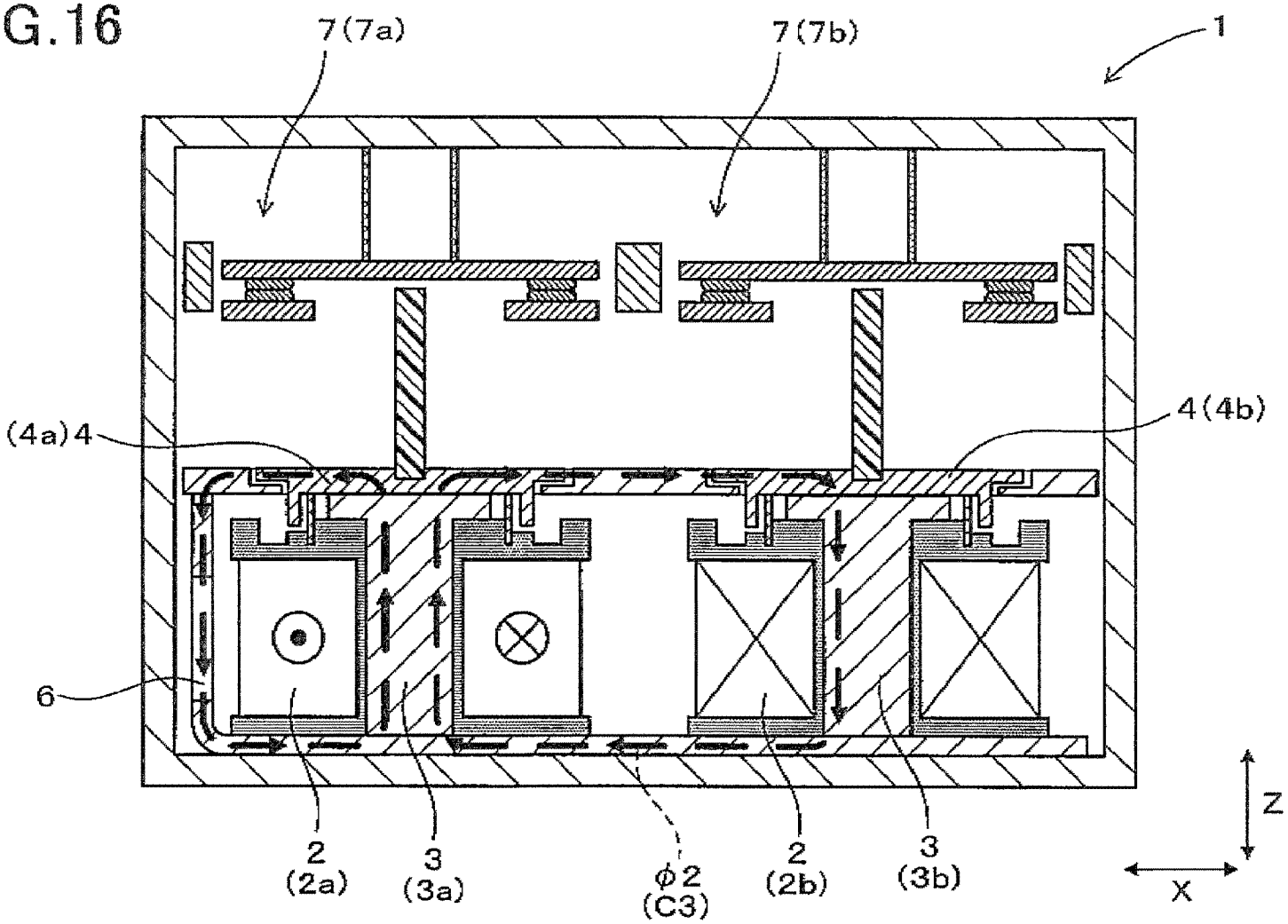
FIG. 16 is a cross-sectional view of the solenoid device in a dual-attracting state in the comparison example.

As a result, the magnetic fluxes φ apparently do not flow through the third magnetic circuit C3, and only the first plunger 4*a* is attracted. In addition, when both of the two plungers 4*a* and 4*b* are attracted, as shown in FIG. 16, energization of the second electromagnetic coil 2*b* is stopped. As a result, the magnetic flux φ2 of the second electromagnetic coil 2*b* dissipates and the magnetic flux φ1 of the first electromagnetic coil 2*a* flows through the third magnetic circuit C3. Consequently, both of the two plungers 4*a* and 4*b* are attracted to the stationary cores 3.

However, in the above-described configuration, as shown in FIG. 15, when only the first plunger 4*a* is attracted, the amount of magnetic flux φ1 of the first electromagnetic coil 2*a* and the amount of magnetic flux φ2 of the second electromagnetic coil 2*b* flowing through the third magnetic circuit C3 are required to be substantially equal. When the amounts of the magnetic fluxes φ1 and φ2 significantly differ, cancellation of the magnetic fluxes φ1 and φ2 cannot be completely performed, and the magnetic fluxes φ1 and φ2 flow through the third magnetic circuit C3. Consequently, both of the two plungers 4*a* and 4*b* may be attracted. In particular, when a temperature difference occurs between the two electromagnetic coils 2*a* and 2*b*, the magnetic fluxes φ1 and φ2 become unbalanced. Attraction of both of the two plungers 4*a* and 4*b* tends to occur.

For example, when the current is temporarily stopped after the two plungers 4*a* and 4*b* are attracted through energization of the first electromagnetic coil 2*a* (see FIG. 16), and subsequently, only the first plunger 4*a* is again attracted, the temperature of the first electromagnetic coil 2*a* is increased as a result of the immediately preceding operation. However, the temperature of the second electromagnetic coil 2*b* has relatively decreased. When the temperature increases, electrical resistance in the electromagnetic coil 2 increases, and the amount of flowing current decreases. Therefore, when the temperatures of the electromagnetic coils 2*a* and 2*b* differ from each other, the magnetic fluxes φ1 and φ2 tend to become unbalanced.

Consequently, as shown in FIG. 15, when only the first plunger 4*a* is attracted, the magnetic fluxes φ1 and φ2 are not sufficiently canceled in the third magnetic circuit. Both of the two plungers 4*a* and 4*b* may be attracted. In addition, when the magnetic fluxes φ1 and φ2 are canceled and only the first plunger 4*a* is attracted, the magnetic flux φ1 for attracting the first plunger 4*a* and the magnetic flux φ2 for canceling the magnetic flux φ1 are required to be sent to the first stationary core 3*a*. The necessity for thickening the first stationary core 3*a* tends to arise.

Meanwhile, as shown in FIG. 3, when the magnetism limiting portion 6 is not formed in the first magnetic circuit C1 according to the present embodiment, the magnetic resistance in the first magnetic circuit C1 can be reduced. Most of the magnetic flux φ1 of the first electromagnetic coil 2*a* can be sent to only the first magnetic circuit C1. Therefore, the magnetic flux φ1 hardly flows through the third magnetic circuit C3. Cancellation of the magnetic flux φ1 of the first electromagnetic coil 2*a* flowing through the third magnetic circuit C3 by the magnetic flux φ2 of the second electromagnetic coil 2*b*, which is conventionally required, is no longer required. Consequently, stable attraction of only the first plunger 4*a* becomes possible.

According to the present embodiment, as shown in FIG. 5, the magnetism limiting portion 6 is formed in the second magnetic circuit C2. Therefore, the magnetic resistance in the second magnetic circuit C2 can be increased. As a result, as shown in FIG. 4, when the two, electromagnetic coils 2*a* and 2*b* are energized, the magnetic flux φ2 of the second electromagnetic coil 2*b* can also be sent to the third magnetic circuit C3. Consequently, both of the two plungers 4*a* and 4*b* can be attracted through energization of the two electromagnetic coils 2*a* and 2*b*. Subsequently, as shown in FIG. 5, when energization of the first electromagnetic coil 2*a* is stopped, both of the two plungers 4*a* and 4*b* can be continuously attracted because the magnetic flux φ2 of the second electromagnetic coil 2*b* continues to flow through the third magnetic circuit C3. As a result, the two plungers 4*a* and 4*b* can be continuously attracted in a state in which only the second electromagnetic coil 2*b* is energized, that is, a state in which power consumption is reduced.

As shown in FIG. 5, according to the present embodiment, the magnetism limiting portion 6 is formed in a portion of the second magnetic circuit C2 that does not overlap the third magnetic circuit C3.

The magnetism limiting portion 6 can be formed in a portion of the second magnetic circuit C2 that overlaps the third magnetic circuit C3, such as the second stationary core 3*b*. However, in this case, the magnetic resistance in the third magnetic circuit C3 may increase. As a result, the magnetic flux φ2 of the second electromagnetic coil 2*b* may not sufficiently flow through the third magnetic circuit C3 when the dual-energized state is maintained through energization of only the second electromagnetic coil 2*b*. Meanwhile, as according to the present embodiment, when the magnetism limiting portion 6 is formed in a portion of the second magnetic circuit C2 that does not overlap the third magnetic circuit C3, increase in the magnetic resistance in the third magnetic circuit C3 can be suppressed. Consequently, as shown in FIG. 5, the magnetic flux φ2 of the second electromagnetic coil 2*b* can be sufficiently sent to the third magnetic circuit C3. Attraction force on the two plungers 4*a* and 4*b* can be increased.

The magnetism limiting portion 6 of the present embodiment is the magnetically-saturated portion 60 in which magnetism is at saturation. The magnetically-saturated portion 60 is configured by a portion of the yoke 5 configuring the second magnetic circuit C2.

As described hereafter, a slit 61 (see FIGS. 12 and 13) may be formed in the yoke 5. The slit 61 may serve as the magnetism limiting portion 6. In this case, adjustment of the amount of flowing magnetic flux becomes difficult. In the present embodiment, a portion of the yoke 5 serves as the magnetically-saturated portion 60 and the magnetically-saturated portion 60 serves as the magnetism limiting portion 6. Thus, the amount of flowing magnetic flux can be more easily adjusted.

In addition, the solenoid system 10 according to the present embodiment includes the control unit 8 that controls energization of the electromagnetic coils 2. As shown in FIG. 4, when both of the two electromagnetic coils 2*a* and 2*b* are energized, the orientation of the current flowing through each of the electromagnetic coils 2*a* and 2*b* is prescribed such that the magnetic flux φ1 of the first electromagnetic coil 2*a* and the magnetic flux φ2 of the second electromagnetic coil 2*b* flow in the same direction in the third magnetic circuit C3.

Therefore, the magnetic fluxes φ1 and φ2 flowing through the third magnetic circuit C3 can reinforce each other. Consequently, a strong magnetic force can be generated by the magnetic fluxes φ1 and φ2 flowing through the third magnetic circuit C3. The two plungers 4*a* and 4*b* can be firmly attracted.

As shown in FIGS. 4 and 5, the control unit 8 stops energization of the first electromagnetic coil 2*a* after energizing both of the two electromagnetic coils 2*a* and 2*b*. As a result, the magnetic flux φ2 of the second electromagnetic coil 2*b* flows through the second magnetic circuit C2 and the third magnetic circuit C2, and both of the plungers 4*a* and 4*b* can be continuously attracted. Therefore, the two plungers 4*a* and 4*b* can be continuously attracted merely through energization of the second electromagnetic coil C3. Power consumption of the solenoid device 1 can be reduced.

As shown in FIGS. 5 and 7, a portion of the magnetic flux φ2 of the second electromagnetic coil 2*b* flows through the fourth magnetic circuit C4. The auxiliary magnetism limiting portion 51 is formed in a portion of the yoke 5 that configures the fourth magnetic circuit C4, but does not configure the first magnetic circuit C1 and the third magnetic circuit C3. Therefore, the amount of magnetic flux φ2 of the second electromagnetic coil 2*b* flowing through the fourth magnetic circuit C4 can be reduced. Consequently, the amount of magnetic flux φ2 flowing through the second magnetic circuit C2 and the third magnetic circuit C3 can be increased. Attraction force on the plungers 4*a* and 4*b* can be increased.

As described above, according to the present embodiment, a solenoid device that is capable of stably attracting only either of two plungers, and reducing power consumption when attracting both of the two plungers, and a solenoid system in which the solenoid device is used can be provided.

According to an embodiment described below, reference numbers used in the drawings that are the same as those used according to the first embodiment indicate constituent elements similar to those according to the first embodiment, unless otherwise noted.

Second Embodiment

Figure 12:
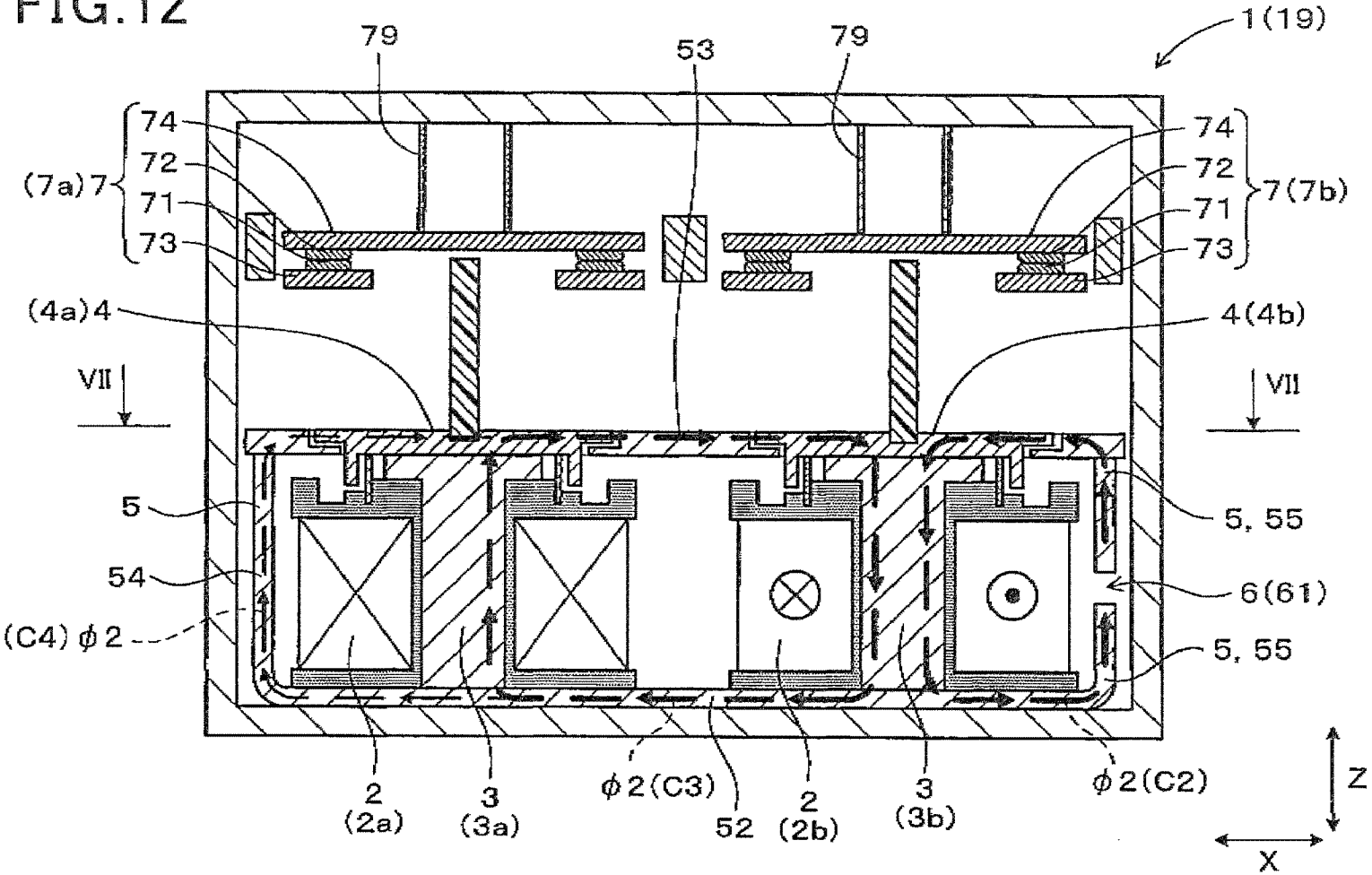
FIG. 12 is a cross-sectional view of a solenoid device according to a second embodiment.
Figure 13:
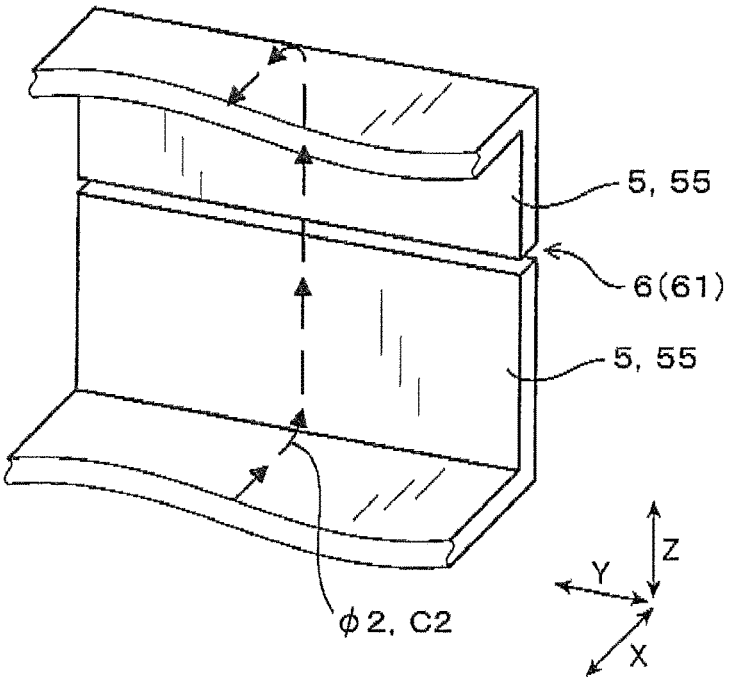
FIG. 13 is a perspective view of a second side wall portion of the solenoid device according to the second embodiment.

According to a second embodiment, the shape of the second side wall portion 55 is modified. As shown in FIGS. 12 and 13, according to the present embodiment, a slit 61 is formed in the portion (second side wall portion 55) of the yoke 5 configuring the second magnetic circuit C2. The slit 61 divides the yoke 5 into two. More specifically, according to the present embodiment, the slit 61 divides the second side wall portion 55 of the yoke 5 into two, in the forward-backward direction (Z direction) of the plungers 4. The slit 61 configures the magnetism limiting portion 6.

Working effects according to the present embodiment will be described. As described above, according to the present embodiment, the slit 61 is formed in the portion (second side wall portion 55) of the yoke 5 configuring the second magnetic circuit C2. Therefore, the amount of magnetic flux φ2 flowing to the second magnetic circuit C2 can be further limited. Consequently, the amount of magnetic flux φ2 flowing to the third magnetic circuit C3 can be increased. The first plunger 4*a* can be firmly attracted in the dual-attracting state. In addition, configurations and working effects similar to those according to the first embodiment are achieved.

What is claimed is:

1. A solenoid device comprising:

two electromagnetic coils that are configured by a first electromagnetic coil and a second electromagnetic coil, the first electromagnetic coil being energized to generate magnetic flux, the second electromagnetic coil being energized to generate magnetic flux;

two stationary cores that are configured by a first stationary core and a second stationary core, the first stationary core being disposed within the first electromagnetic coil, the second stationary core being disposed within the second electromagnetic coil;

two plungers that are configured by a first plunger and a second plunger, the first plunger being attracted to the first stationary core by energization of the first electromagnetic coil, the second plunger being attracted to the second stationary core by energization of the second electromagnetic coil; and a yoke that surrounds the two electromagnetic coils, wherein:

in a dual-deenergized state in which neither of the two electromagnetic coils is energized, the first plunger is separated from the first stationary core and the second plunger is separated from the second stationary core;

when the dual-deenergized state is changed to a state in which only the first electromagnetic coil of the two electromagnetic coils is energized, the magnetic flux of the first electromagnetic coil flows through a first magnetic circuit that includes only the first stationary core of the two stationary cores, and the first plunger is thereby attracted to the first stationary core while maintaining a state in which the second plunger is separated from the second stationary core;

in a dual-energized state in which both of the two electromagnetic coils are energized, the magnetic flux of the first electromagnetic coil flows through the first magnetic circuit and the magnetic flux of the second electromagnetic coil flows through a second magnetic circuit that includes only the second stationary core of the two stationary cores, and as a result of a magnetic force that is thereby generated, the first plunger is attracted to the first stationary core, and the second plunger is attracted to the second stationary core, and the magnetic fluxes, respectively generated from the first electromagnetic coil and the second electromagnetic coil, flow through a third magnetic circuit that includes the two stationary cores;

when, from the dual-energized state, energization of the first electromagnetic coil is stopped while maintaining energization of the second electromagnetic coil, the magnetic flux of the second electromagnetic coil continues to flow through the second magnetic circuit and the third magnetic circuit, and as a result of a magnetic force that is thereby generated, a dual-attracting state in which the first plunger is attracted to the first stationary core and the second plunger is attracted to the second stationary core is maintained;

a magnetism limiting portion that limits magnetic flux is provided in only the second magnetic circuit, of the first magnetic circuit and the second magnetic circuit; and the magnetism limiting portion being disposed in a portion of the second magnetic circuit that does not overlap the third magnetic circuit.

2. The solenoid device according to claim 1, wherein:

the magnetism limiting portion is a magnetically-saturated portion that is configured by a portion of the yoke and in which magnetism is at saturation.

3. The solenoid device according to claim 1, wherein:

a slit that divides the yoke is formed in the yoke configuring the second magnetic circuit, and the slit configures the magnetism limiting portion.

4. A solenoid system comprising:

a solenoid device including:

two electromagnetic coils that are configured by a first electromagnetic coil and a second electromagnetic coil, the first electromagnetic coil being energized to generate magnetic flux, the second electromagnetic coil being energized to generate magnetic flux;

two stationary cores that are configured by a first stationary core and a second stationary core, the first stationary core being disposed within the first electromagnetic coil, the second stationary core being disposed within the second electromagnetic coil:

two plungers that are configured by a first plunger and a second plunger, the first plunger being attracted to the first stationary core by energization of the first electromagnetic coil, the second plunger being attracted to the second stationary core by energization of the second electromagnetic coil; and a yoke that surrounds the two electromagnetic coils; and a control unit that controls energization of the two electromagnetic coils, wherein:

in a dual-deenergized state in which neither of the two electromagnetic coils is energized, the first plunger is separated from the first stationary core and the second plunger is separated from the second stationary core;

when the dual-deenergized state is changed to a state in which only the first electromagnetic coil of the two electromagnetic coils is energized, the magnetic flux of the first electromagnetic coil flows through a first magnetic circuit that includes only the first stationary core of the two stationary cores, and the first plunger is thereby attracted to the first stationary core while maintaining a state in which the second plunger is separated from the second stationary core;

in a dual-energized state in which both of the two electromagnetic coils are energized, the magnetic flux of the first electromagnetic coil flows through the first magnetic circuit and the magnetic flux of the second electromagnetic coil flows through a second magnetic circuit that includes only the second stationary core of the two stationary cores, and as a result of a magnetic force that is thereby generated, the first plunger is attracted to the first stationary core, and the second plunger is attracted to the second stationary core, and the magnetic fluxes, respectively generated from the first electromagnetic coil and the second electromagnetic coil, flow through a third magnetic circuit that includes the two stationary cores;

when, from the dual-energized state, energization of the first electromagnetic coil is stopped while maintaining energization of the second electromagnetic coil, the magnetic flux of the second electromagnetic coil continues to flow through the second magnetic circuit and the third magnetic circuit, and as a result of a magnetic force that is thereby generated, a dual-attracting state in which the first plunger is attracted to the first stationary core and the second plunger is attracted to the second stationary core is maintained;

a magnetism limiting portion that limits magnetic flux is provided in only the second magnetic circuit, of the first magnetic circuit and the second magnetic circuit; and the magnetism limiting portion being disposed in a portion of the second magnetic circuit that does not overlap the third magnetic circuit; and when the dual-energized state is entered by the control unit, orientation of a current flowing to each of the electromagnetic coils is prescribed such that the magnetic flux of the first electromagnetic coil and the magnetic flux of the second electromagnetic coil flow in a same direction in the third magnetic circuit.

5. The solenoid system according to claim 4, wherein:

the control unit is configured to stop energization of the first electromagnetic coil after the dual-energized state, and allow the magnetic flux of the second electromagnetic coil to flow to the second magnetic circuit and the third magnetic circuit, thereby continuously maintaining the dual-attracting state.

6. The solenoid system according to claim 5, wherein:

a portion of the magnetic flux of the second electromagnetic coil flows through a fourth magnetic circuit that includes only the second stationary core, of the two stationary cores, and the yoke, and partially overlaps the first magnetic circuit and the third magnetic circuit, and an auxiliary magnetism limiting portion that limits magnetic flux is formed in a portion of the yoke that configures the fourth magnetic circuit and does not overlap the first magnetic circuit and the third magnetic circuit.

* * * * *